United States Patent [19]

Harvey

[11] 4,036,422

[45] July 19, 1977

[54] ROOFING NAIL APPLICATOR

[75] Inventor: William R. Harvey, Hinckley, Ohio

[73] Assignee: Lexsuco, Inc., Solon, Ohio

[21] Appl. No.: 573,008

[22] Filed: Apr. 30, 1975

[51] Int. Cl.[2] ..... B27F 7/02

[52] U.S. Cl. ..... 227/110

[58] Field of Search ..... 227/110, 111, 113, 129, 227/133

[56] References Cited

U.S. PATENT DOCUMENTS

| | | | |
|---|---|---|---|
| 1,693,290 | 11/1928 | Fawcett | 227/111 |
| 3,666,155 | 5/1972 | Saluzzi | 227/110 |

*Primary Examiner*—Granville Y. Custer, Jr.

[57] ABSTRACT

An apparatus for driving roofing nails into a roof deck or the like. A carriage is movable with respect to the surface of a roof deck, and carries one or more weights for movement therewith. Means are provided for raising a weight to a raised position a predetermined distance above the roof deck and for aligning a roofing nail below said weight with the head of said nail facing said weight. Control means are provided for releasing said weight means to enable said weight means to accelerate under the influence of gravity for imparting a force to said nail in a direction tending to drive said nail into said roof deck.

7 Claims, 8 Drawing Figures

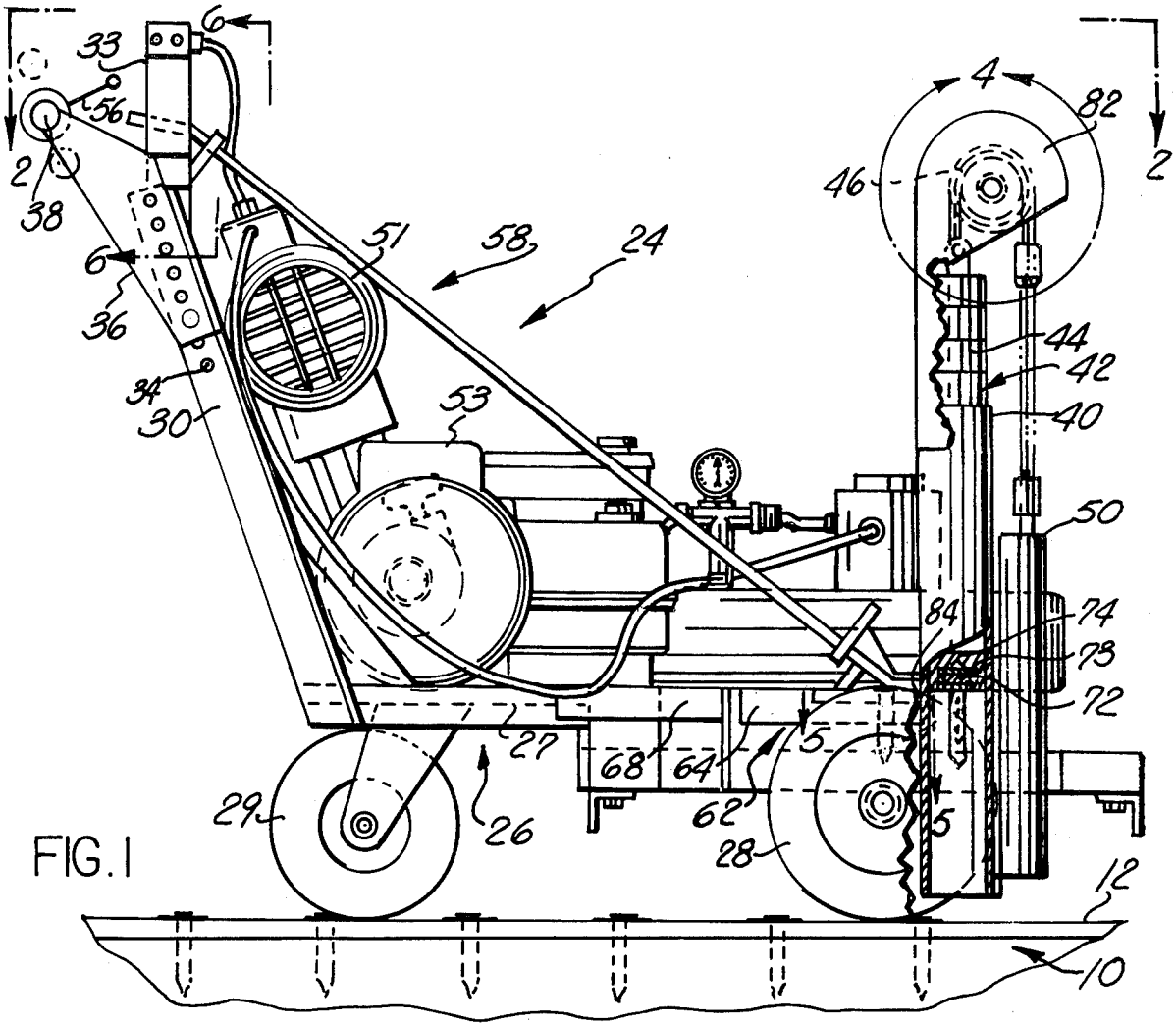
FIG. 1
FIG. 2
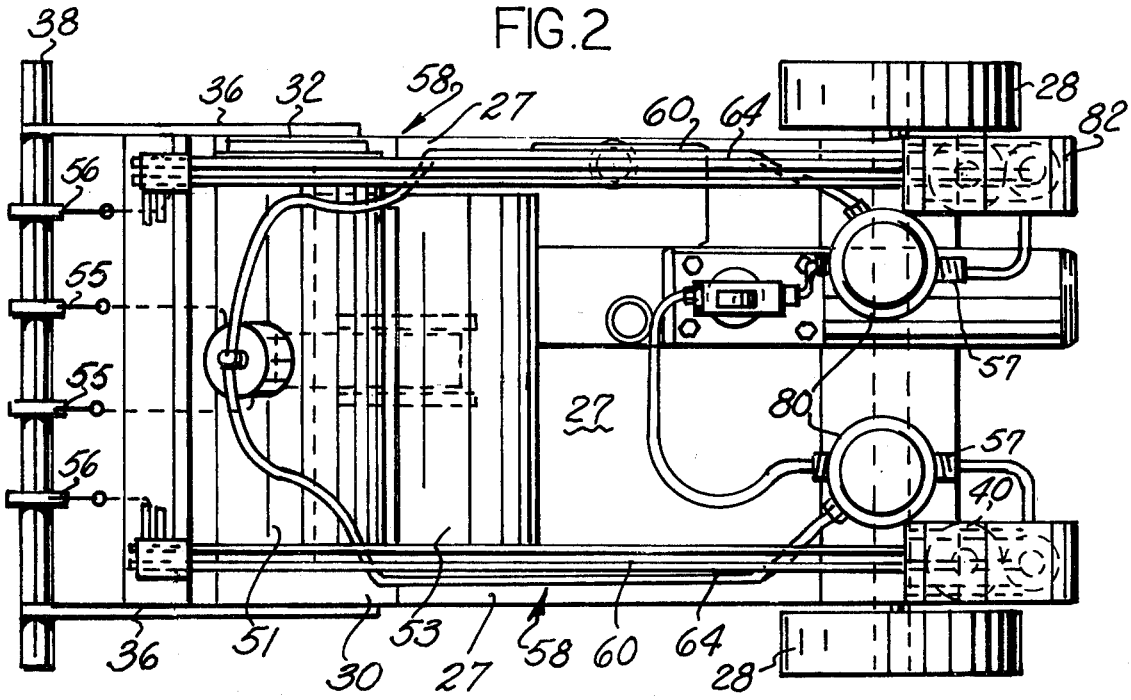

ROOFING NAIL APPLICATOR

BACKGROUND OF THE INVENTION

This application relates to the art of driving a nail, or other comparable fastener, into a piece of material. It has particular application to the art of driving roofing nails, or the like, for securing insulation to a roof deck.

It has been customary in applying insulation to a roof deck to manually hammer the roofing nails through the insulation and deck. This is a fairly time consuming operation. There has been a need in the roofing art for a nail applicator which reduces the amount of manual labor involved in the application of the roofing nails, and yet which is safe, easy to operate, and which is capable of effectively driving roofing nails through insulation and roof deck.

SUMMARY OF THE PRESENT INVENTION

According to the preferred embodiment of the present invention, there is provided a roofing nail applicator which is safe, easy to manipulate, which minimizes the expenditure of energy, and which is capable of effectively driving roofing nails through insulation and into a roof deck.

Moreover, the principles of the present invention may be readily applied for driving fasteners into various types of materials in addition to roof insulation and decks.

Briefly, the present invention provides a weight which is designed to apply the driving force to a nail or fastener by means of a gravity drop of the weight over a predetermined distance. Means are provided for supporting the weight a predetermined vertical distance above an area through which the nail or fastener is to be driven and for releasing the weight to enable it to drop from that first position almost exclusively under the unfluence of gravity.

The preferred embodiment further provides a weight supporting mechanism which is also designed to brake the downward dropping of weight if it drops further than said predetermined distance, and thereby provides an important safety feature when employed in the roofing nail application art.

Accordingly, the primary object of the present invention is to provide a nail or fastener applicator which is safe, easy to operate and maneuver, and which basically functions under and principle of providing a driving force to a nail or fastener by means of the fall of a weight under the influence of gravity.

Other objects and advantages of this invention will become further apparent from the following detailed description and the accompanying drawings wherein:

DESCRIPTION OF THE DRAWINGS

FIG. 1 is a side elevational view of a roofing nail applicator according to the present invention, with portions cut away;

FIG. 2 is a view taken from the direction 2—2 of FIG. 1;

DETAILED DESCRIPTION OF THE PREFERRED EMBODIMENT

As set forth above, the preferred embodiment of the present invention relates to an apparatus for driving roofing nails through insulation and roof decking. It is believed that from the description which follows, the manner in which the principles of the present invention may be applied for driving nails or comparable fasteners into numerous types of materials will be readily apparent to those of ordinary skill in the art.

Figure 3:
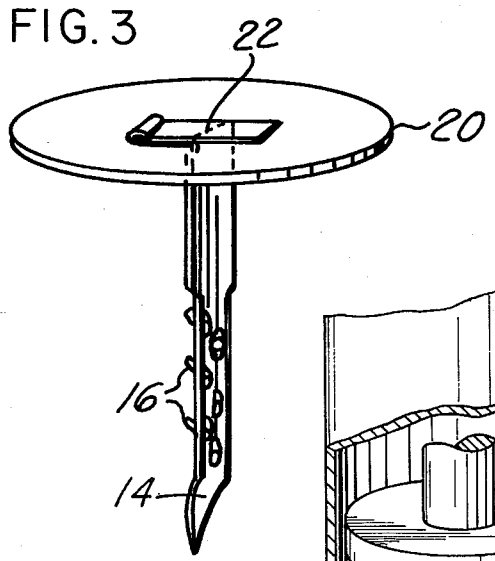
FIG. 3 is a perspective view of a roofing nail with which the preferred embodiment of the present invention is used.
Figure 8:
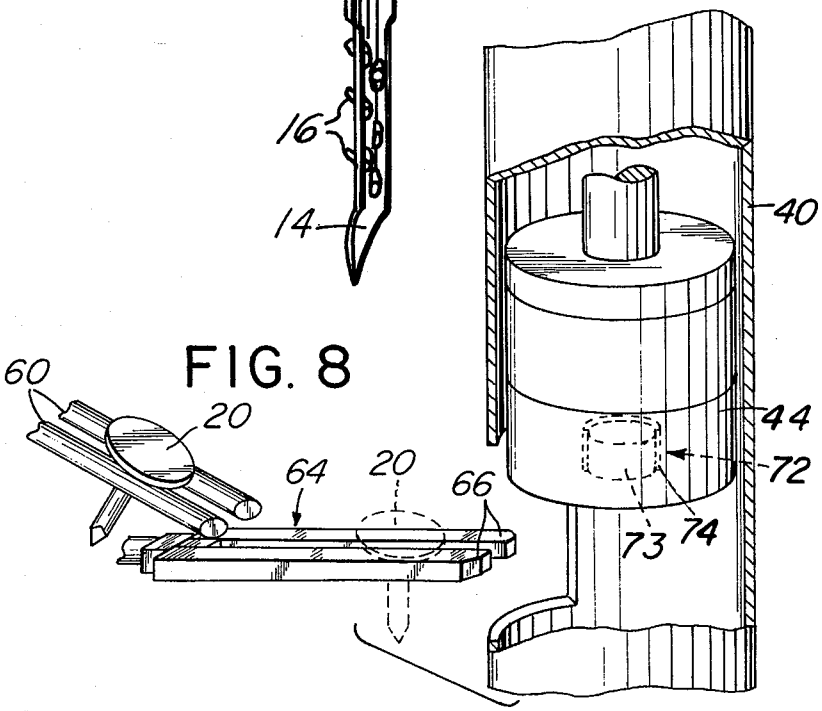
FIG. 8 is an enlarged perspective view of the mechanism for inserting a nail into engagement with the weight.

Referring to the drawings, in FIG. 1, a substantially horizontal roof deck 10 has a layer of insulation 12 placed thereover. The nails which are used to secure the insulation to the deck 10 are shown in FIG. 3 and comprise bent metallic sheets 14 having a plurality of tabs 16 bent to form teeth for retaining the nail against dislodgment from the roof deck. Each nail protrudes through a circular washer 20 which is disposed adjacent the head 22 of the nail. The washer may be preformed with a rectangular slot and the nail inserted therethrough manually, or mechanical means may be provided for piercing a washer with a nail for combining the two.

The nail applicator 24 includes a frame or carriage 26 which is designed to traverse the roof under the hand guidance of an operator. The carriage 26 includes a base plate 27 having a pair of spaced front wheels 28 mounted thereto, and a single rear caster 29 which is mounted to swivel relative to the base plate 27 to help steer the carriage. A pair of frame members 30, 32 extend upwardly from the base plate 27, and include a plurality of recesses 34 at the upper ends thereof. The recesses adjustably support a pair of brackets 36 and a cross-bar 38 is supported between the upper ends of the brackets. The crossbar 38 provides a gripping member for an operator desiring to move the carriage 26 in any desired direction over a roof deck. The adjustability of the brackets enables the crossbar height to be adjusted to accommodate operators of varying heights.

Thus, from the foregoing description, it should be clear that the present invention basically contemplates a carriage which is designed so that an operator can conveniently maneuver the carriage over a roof deck or other surface upon which nails or fasteners are to be applied.

The leading ends of the carriage include a pair of spaced metal cylinders 40. Each cylinder 40 acts as a guide for a weight 42 which is contained within the cylinders and which is designed to be released for gravity fall therein while guided basically by the confines of the cylinder.

Figure 4:
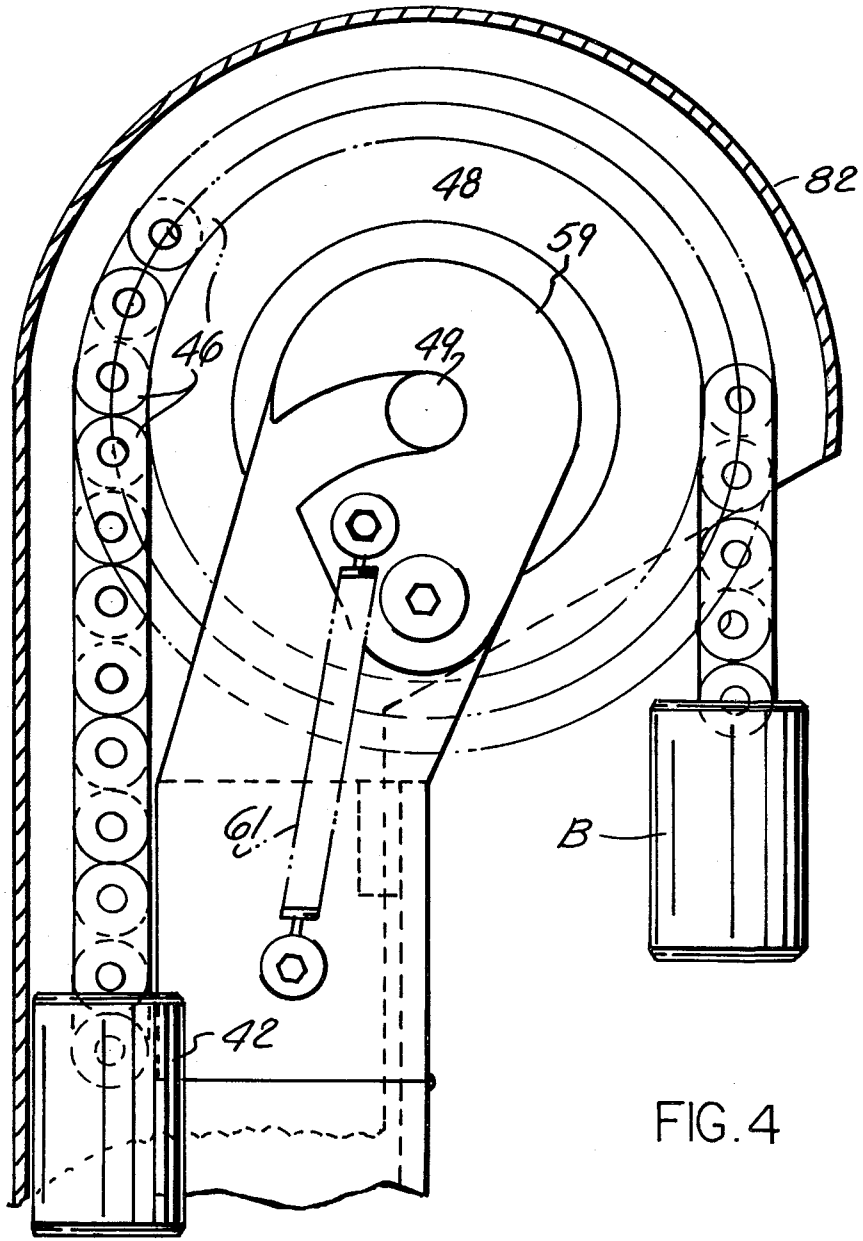
FIG. 4 is an enlarged view, with portions broken away of the area marked 4 in FIG. 1.

Each weight 42 comprises one or more sections 44 which are detachable from one another for varying the magnitude of the weight 42. The upper portion of each weight 42 has detachably mounted thereto, the end portion of a chain 46 which is entrained over a sprocket 48 (see FIG. 4) and which is detachably connected at its other end (such as through a conventional threaded block B) to the reciprocable piston 65 (FIG. 7) of an air cylinder 50. As shown in FIG. 4, the sprocket shaft 49 is removably supported by clamp 59 and spring 61.

Figure 7:
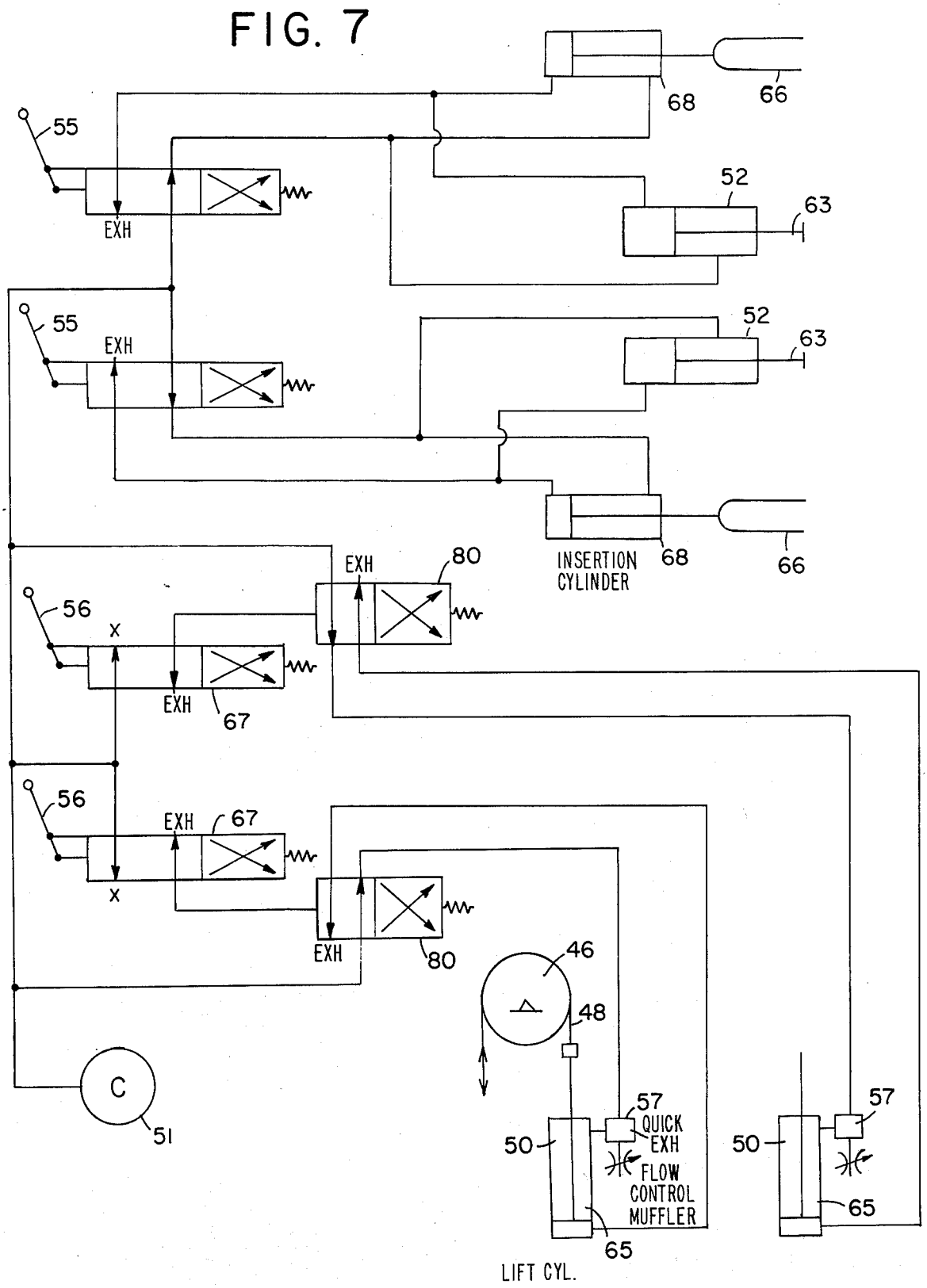
FIG. 7 is a schematic illustration of the pneumatic circuitry for practicing the preferred embodiment of the present invention.

Referring to FIGS. 1, 2, and 7, the reciprocable piston of the air cylinder 50 is supported in a first position by air pressure which is directed to the cylinder from compressor 51. Compressor 51 is driven by engine 53, and communicates with the cylinder 50 through spool valve 80. The spool valve includes an axially movable spool which is spring biased to a first position at which it communicates high pressure fluid to the upper chamber of the air cylinder 50 and exhausts the air from the lower chamber of the air cylinder, to support the piston 65 in its first position and thereby support the weight in a raised position.

In order to permit the weight to drop from its raised position the air cylinder is "fired," i.e. the piston 65 is rapidly driven upwardly to create an almost instantaneous slack in the chain 46. In the preferred embodiment each cylinder is fired by actuating a respective lever operated air valve 56 supported by the carriage 24. Actuation of a lever operated air valve 56 directs a pulse of air to its respective spool valve, which overcomes the bias of the spring and drives the spool to a second position. In the second position the spool valve ports high pressure fluid to the lower chamber of the air cylinder and begins to exhaust fluid from the upper chamber of the cylinder. A quick exhaust valve 57 is designed to open as the upper chamber begins to exhaust, and to immediately exhaust the upper chamber of the cylinder to atmosphere. This results in a rapid movement of the piston 65 in an upward direction to create slack in the chain. When the lever operated air valve 56 is released, the spool valve is permitted to return, under its spring bias, to its first position to slowly raise the weight to its raised position. The return velocity of the weight is controlled by a conventional flow control valve 67.

The aforementioned elements (i.e. air cylinder, spool valve, quick exhaust valve, flow control valve, compressor and engine) for controlling the movement of the weight as set forth above can all be conventional. In the preferred embodiment the following elements have provided satisfactory results: a 3 h.p., single cylinder engine with horizontal crankshaft, made by Briggs & Stratton, Milwaukee, Wisc.; a compressor of the opposed twin piston type, model PCD-10, made by Gast Manufacturing Corp., Denton Harbor, Michigan; model 5340-07 spool valves by Aro Corp., Bryan, Ohio; Aro model 5040-01 lever operated air valves; Aro model EV-375, quick exhaust valves; Aro F-25b flow control valves and air cylinder of any type qualified to style MS1 under the National Fluid Power Association. Other forms of these elements are contemplated, but should require no further explanation to those of ordinary skill in the art.

Figures 5, 6:
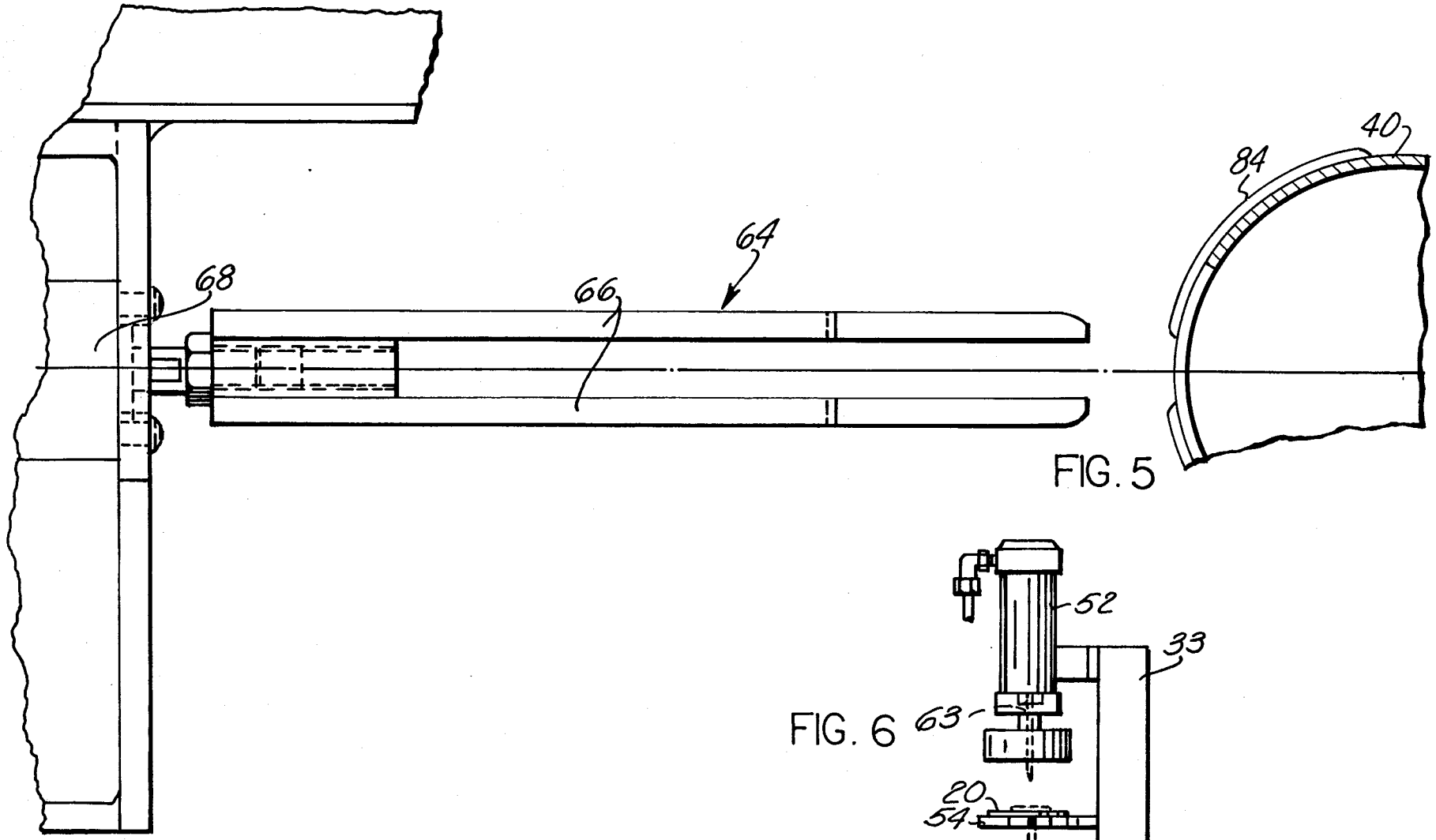
FIG. 5 is a sectional view of the area labeled 5—5 in FIG. 1.
FIG. 6 is an enlarged sectional view on lines 6—6 of FIG. 1.

In the preferred embodiment of this invention a combined nail and washer are attached to the weight before the air cylinder is fired, so that the dropping of the weight serves to drive the nail through the insulation 12 and into the roof deck 10. The nail and washer may be preassembled by manual or mechanical means and may be, therefore, accessible to an operator in a precombined state. Alternatively, as shown in FIG. 6, it is contemplated that the upper portion of the carriage may be provided with a mechanism for combining the nail and washer. One or more reciprocating plungers are reciprocable in a respective cylinder 52 supported by the members 33 each carrying a magnet 63 at its lower end for engaging the head of a nail. Vertically aligned therebelow for supporting a circular washer 20 is a circular member 54 having a central cavity. The plunger is reciprocated to drive the nail through the washer to combine the two. The movement of each plunger is operator controlled by a suitable valving arrangement actuated by a respective handle 55 on the upper portion of the carriage. The same valve also operates the insertion prongs 66. It is contemplated that the number of such mechanism carried by the carriage correspond to the number of weight means.

Once a nail and washer have been assembled, they are placed along a downwardly sloping track 58 which is comprised of a pair of cylindrical bars 60, and which serves to guide the nail under the influence of gravity into position at an inserting station 62. There is a track 58 associated with each of the cylinders.

At the inserting station, a washer rests on a reciprocating inserting member 64 (see FIGS. 1, 2 and 5). The member 64 appears in top view (FIG. 5) as a fork-shaped member for supporting the washer with the nail extending downwardly between a pair of prongs 66. The inserting member 64 is designed for reciprocating motion under the control of an air cylinder 68 which is also controlled by the handle 55 through conventional valving. Separate handles and controls are associated with each inserting member. In addition to the positions shown, it is contemplated that for operator convenience, the handles may be disposed in other locations relative to bar 38. Where the nail is to be punched by the mechanism shown in FIG. 6, the valving is such that in the preferred mode of control, as one nail is driven through a washer, a nail and washer positioned at the inserting station is inserted into the metallic cylinder 40.

When an inserting member is driven towards its respective cylinder it passes through appropriate slots in the cylinder. The nail and washer are thereby carried into the cylinder, and the nail head and the washer are attached to the weight by means of a permanent magnet 72 secured to the weight.

In the preferred embodiment, the magnet 72 is insulated (by means of insulation 73) from the remainder of the weight and a stainless steel non-magnetic plate 74 is secured over the magnet. The stainless steel plate 74 further includes a recess in its lower surface. When the nail and washer are inserted into the metallic cylinder the magnet 72 serves to attract the nail and washer and hold the same fast to the underside of the weight. The recess in the stainless steel plate receives the head of the nail to avoid the nonsymmetrical portion of the head from misaligning the nail as it is driven through the insulation and roof deck.

After the nail and washer have been attached to the weight, and with the carriage positioned so that cylinders have been suitably aligned with the areas through which the nail is to be driven, each weight 42 is released and permitted to fall solely under the influence of gravity for driving the nail through the insulation and the deck. As set forth above, this is accomplished by positively firing the air cylinder 50 which is attached to the sprocket chain 46 to rapidly move the piston 65 of the air cylinder to the second position.

Upon the firing of the air cylinder 50 there is virtually an instantaneous slack provided in the sprocket chain 46. This permits the weight 42 to fall from a raised preset distance solely under the influence of gravity. As the weight falls it drives the nail through the insulation and roof deck. The weight is then raised to its initial position and the nail teeth, which securely engage the deck, release the nail and washer from the weight. As set forth above, the spool-type valve 80 is effective, after the weight has driven the nail through the roof deck, to slowly drive the piston 65 of the air cylinder to its first position to raise the weight into its initial position for subsequent application of another roofing nail. Since the firing of the air cylinder is at a very high speed, there is the danger that in such firing the slack in the chain could release it from its sprocket wheel, a guard 82 is provided suitably close to the sprocket wheel in order to block any tendency of the chain to disengage from the wheel.

Since the chain 46 is always attached to the weight and to the air cylinder 50, even while the weight is dropping, the chain serves to brake the fall of the weight by limiting the downward travel of the weight, which could otherwise fall completely through the insulation of a steel deck. An additional feature resides in the annular guard 84 (FIG. 5) provided on the metallic cylinder. This guard is spaced just vertically below the lowermost portion of the slot through which the inserting element 64 moves. This prevents undue damage to the machine in the unlikely event that the inserting mechanism and the weight release mechanism are inadvertently simultaneously triggered.

The disclosed embodiment contemplates a weight of 50 pounds designed to drop approximately 11 inches for driving 2¼ inch to 3¼ inch roofing nails through 1–2 inch insulation. It will be readily obvious to those of ordinary skill in the art how the present invention can be modified for numerous sizes of nails and numerous insulation thicknesses.

While the preferred embodiment discloses a pair of spaced cylinders, it is contemplated that more or less numbers of cylinders (and associated controls and tracks) may be employed, if desired. It is also contemplated that while the air supply and air pressurizing mechanism are preferably mounted on the carriage, the present invention can be operated off of any comparable source of pressurized air.

In operation, the carriage is manipulated by an operator in order to align one or both of the weight guiding cylinders with a desired spot (or spots) at which a nail is to be driven into the roof insulation and roof deck. If a nail has already been magnetically attached to the weight the operator simply actuates the appropriate lever 56 to fire the air cylinder 61 to drive the nail into the desired portion of the roof deck. After driving the roofing nail into the roof deck the weight is then returned to a raised position to await insertion of a subsequent nail. Either during movement, or with the apparatus at rest, an operator can place a nail into position to be connected to magnet 63, and the operator can then actuate lever 55 which both reciprocates magnet 63 to drive the nail into engagement with its appropriate washer, and also to reciprocate prongs 66 to insert any nail which is resting thereon into engagement with the weight. The apparatus is then in a condition to drive the inserted nail into any desired location on the roof deck.

With the foregoing description in mind, numerous applications and advantages of this invention, using the concepts of the present invention, will become readily apparent to those of ordinary skill in the art.

I claim:

1. Apparatus for driving a fastener into a portion of a piece of material, said apparatus comprising a weight adapted to be supported in a raised position a predetermined vertical distance above the portion of said material, said weight including a fastener impacting portion, means for aligning said fastener with said fastener impacting portion of said weight, means for releasing said weight to enable it to accelerate from said raised position under the influence of gravity for imparting a force to said fastener to drive said fastener into said portion of said material and including an air actuatable piston, a chain having a first portion thereof secured to said weight, a second portion of said chain being secured to a portion of said air actuatable piston, a pulley adapted to engage said chain between said first and second portions, said means for releasing said weight further including means associated with said air actuatable piston for rapidly moving said piston in a first direction for rapidly urging said chain in a first direction tending to create sufficient slack between the first and second portions of the chain to permit said weight to fall said predetermined distance under the influence of gravity, means associated with said air actuatable piston for moving said piston in a second direction for moving said chain in a second direction for raising said weight to said raised position after weight has driven said fastener into said material and for maintaining said weight in the raised position until released by said means for releasing said weight, said air actuatable piston cooperating with said chain to prevent said weight from dropping more than a predetermined distance greater than said predetermined vertical distance.

2. Apparatus as set forth in claim 1 wherein said air actuatable piston comprises a single-acting piston secured to said chain and being moveable in said second direction for moving said chain in said second direction to raise said weight to said raised position, said means for releasing said weight including valve means for porting air to and from said single-acting piston to move said piston and thereby said chain in said first or second direction.

3. Apparatus as set forth in claim 2 further including guide means for aligning said weight with said portion of said material.

4. Apparatus as set forth in claim 3 wherein said weight and said guide means are carried by a carriage which is movable with respect to said material.

5. Apparatus for driving a fastener such as a roofing nail into a portion of a piece of material, said apparatus comprising a weight movable under the influence of gravity from a raised position to a lowered position to drive a fastener, said weight having an impacting portion, means for supporting said weight for transverse movement relative to a piece of material to align the weight with the portion of the piece of material, a cylinder, a piston associated with said cylinder to at least partially define first and second variable volume chambers, said piston being moveable in said cylinder between a first position in which said first variable volume chamber has a relatively large volume and a second position in which said first variable volume chamber has a relatively small volume, means for connecting said piston and said weight, said connector means being effective to hold said weight in a raised position above the material when said piston is in said first position and said first variable volume chamber has a relatively large volume, said connector means being ineffective to hold said weight in said raised position against the influence of gravity when said piston is in said second position and said first variable volume chamber has a relatively small volume, valve means associated with said cylinder and said piston and operable in a first condition exhausting fluid from said first variable volume chamber when said piston is in said first position to enable the volume of said variable volume chamber to be decreased by movement of said piston from said first position to said second position, said valve means being operable in a second condition porting relatively high pressure fluid to said first variable volume chamber when said piston is in said second position to effect an increase in the volume of said first variable volume chamber to move said piston from said second position to said first position, manually operable actuating means cooperable with said valve means, said manually operable actuating means having a first position for placing said valve means in said first condition and a second position for placing said valve means in said second condition, said actuating means being normally in said second position and being manually operable to said first position for placing said valve means in said first condition, said means for returning said actuating means to said second condition upon release of said actuating means, and means for aligning a fastener with the impacting portion of said weight when said weight is in said raised position.

6. Apparatus as defined in claim 5 including an elongated flexible member having a first portion connected to said weight and second portion connected to said piston, said means for moving said piston to said first position being effective to place said flexible member in a substantially taut condition to hold said weight in said raised position, said valve means being effective in said first condition to port fluid to one side of said piston to urge said piston toward said second position and to rapidly exhaust fluid from said first variable volume chamber and to port fluid to said second variable volume chamber to move said piston rapidly to said second position to rapidly create slack in said flexible member to allow said weight to accelerate from said raised position substantially under the influence of gravity.

7. Apparatus as defined in claim 6 including moveable carriage means for supporting said weight for movement relative to the piece of material to align the weight with the portion of the piece of material, a magnet connected with the impacting portion of said weight, and means carried by said carriage means and selectively actuatable for feeding a fastener into engagement with said magnet on said weight when said weight is in said raised position, so that said weight carries the fastener downward with it after being released to impart the force to the fastener to drive the fastener into the piece of material.

* * * * *